United States Patent [19]

Keller

[11] Patent Number: 4,894,005

[45] Date of Patent: Jan. 16, 1990

[54] COMBUSTION CHAMBER ARRANGEMENT WITH A PRE-COMBUSTION CHAMBER FOR SUBSTOICHIOMETRIC COMBUSTION

[75] Inventor: Jakob Keller, Dottikon, Switzerland

[73] Assignee: BBC Brown Boveri AG, Baden, Switzerland

[21] Appl. No.: 63,480

[22] Filed: Jun. 18, 1987

[30] Foreign Application Priority Data

Jul. 8, 1986 [CH] Switzerland ..... 2748/86

[51] Int. Cl.[4] ..... F23L 1/00

[52] U.S. Cl. ..... 431/115; 431/9; 431/10; 431/158; 431/351; 60/750; 60/755

[58] Field of Search ..... 431/173, 171, 168, 347, 431/115, 157, 158, 9, 10, 351; 60/744, 745, 39.34, 39.78, 732, 734, 738, 722, 737, 750, 755

[56] References Cited

U.S. PATENT DOCUMENTS

| | | | |
|---|---|---|---|
| 792,642 | 6/1905 | Williams | 431/9 |
| 871,070 | 11/1907 | Schwartz | 431/9 |
| 1,052,588 | 2/1913 | Janicki | 60/738 |
| 1,987,400 | 1/1935 | Hillhouse | 431/173 |
| 2,143,259 | 1/1939 | Clarkson | 431/351 X |
| 2,217,649 | 10/1940 | Goddard | 431/158 X |
| 2,346,333 | 4/1944 | Schaumann | 431/173 |
| 2,456,402 | 12/1948 | Goddard | 431/173 |
| 2,483,780 | 10/1949 | Parmele | 431/173 |
| 2,635,564 | 4/1953 | Havemann | 431/173 |
| 2,651,913 | 9/1953 | Hodgson . | |
| 2,694,291 | 11/1954 | Rosengart | 60/745 |
| 2,715,816 | 8/1955 | Thorn . | |
| 2,778,327 | 1/1957 | Sifrin et al. | 431/173 |
| 2,869,629 | 1/1959 | Nerad | 431/351 X |
| 2,924,937 | 2/1960 | Leibach | 60/745 |
| 2,933,296 | 4/1960 | Spangler | 431/355 X |
| 2,967,394 | 1/1961 | Jensen | 60/737 |
| 3,306,334 | 2/1967 | Goubsky | 431/352 X |
| 3,808,803 | 5/1974 | Salvi | 60/737 |
| 4,035,137 | 7/1977 | Arand | 431/351 X |
| 4,040,252 | 8/1977 | Mosier et al. | 60/737 |
| 4,050,238 | 9/1977 | Holzapfel | 60/737 |
| 4,098,075 | 7/1978 | Greenberg et al. | 431/173 |
| 4,504,211 | 3/1985 | Beardmore | 431/10 X |
| 4,561,257 | 12/1985 | Kwan et al. | 60/737 |
| 4,606,720 | 8/1986 | Harvey | 431/347 |
| 4,683,541 | 7/1987 | David | 431/173 |

FOREIGN PATENT DOCUMENTS

| | | | |
|---|---|---|---|
| 1021646 | 12/1957 | Fed. Rep. of Germany . | |
| 2203023 | 5/1974 | France . | |
| 2241005 | 3/1975 | France . | |
| 0017219 | 2/1977 | Japan | 431/173 |
| 0152232 | 11/1979 | Japan | 431/173 |
| 0119404 | 9/1981 | Japan | 431/173 |
| 163686 | 11/1933 | Switzerland . | |
| 0589452 | 1/1978 | U.S.S.R. | 431/173 |

OTHER PUBLICATIONS

Search Report issued in corresponding European Patent Application, together with references.

*Primary Examiner*—Carl D. Price

*Attorney, Agent, or Firm*—Burns, Doane, Swecker & Mathis

[57] ABSTRACT

The pre-combustion chamber (1), in which liquid fuel is burnt sub-stoichiometrically, is connected upstream of a secondary combustion chamber (16), in which complete combustion takes place over-stoichiometrically. The sub-stoichiometric quantity of combustion air (11) for the pre-combustion chamber (2) is injected close to the wall from the outlet duct (3) upwards into the casing (2), which has a heart-shaped axial cross-section. The injection nozzles (7) for the fuel are positioned so that the jets of fuel (8) shield the layer of combustion air close to the wall from the partially burnt combustion mixture flowing through the outlet duct (3) into the secondary combustion chamber (16). At the end of the outlet duct (3) the quantity of auxiliary air required for complete combustion in the secondary combustion chamber (16) is added to the partially burnt combustion mixture.

13 Claims, 1 Drawing Sheet

COMBUSTION CHAMBER ARRANGEMENT WITH A PRE-COMBUSTION CHAMBER FOR SUBSTOICHIOMETRIC COMBUSTION

This invention relates to a combustion chamber arrangement with a pre-combustion chamber for sub-stoichiometric combustion, wherein the combustion mixture, which has been incompletely burned in a casing of the pre-combustion chamber, is completely burned in a secondary combustion chamber with a large excess of air.

BACKGROUND OF THE INVENTION

Combustion processes which take place at high temperatures cause unacceptably high $NO_x$ emissions, he avoidance or reduction of which is nowadays required by the authorities in certain countries for reasons of environmental protection. This principally concerns industrial combustion plants and also, in particular, gas turbines. Pre-mix burners have therefore been developed for the latter for gas firing. This technology of pre-mix combustion is the most promising method for substantial reduction of $NO_x$ formation with gaseous fuels.

In practice this technology cannot be applied to liquid fuels on account of the short ignition delay time-diesel ignition occurs at high pressure. Other possibilities were need for liquid fuel combustion with low generation of pollutants. Allowing the combustion to take place in two phases appeared to be a promising method. In this so-called two-stage combustion, pre-combustion of the fuel takes place in a pre-combustion chamber under sub-stoichiometric mixing conditions, for instance at an air ratio $\lambda=0.7$. With such a strongly sub-stoichiometric combustion, very little $NO_x$ is produced, whereas in an approximately stoichiometric mixture, that is with $\lambda$ close to 1, $NO_x$ is formed. Likewise, in combustion processes with $\lambda>>1$, that is with a large excess of air and a correspondingly cool flame, only a small amount of $NO_x$ is produced.

The reactions involved in the formation of $NO_x$ take place relatively slowly so that it is possible to avoid a high production rate of $NO_x$, which occurs at $\lambda=1$, by very rapid addition of air to the mixture of combustion gases and still unburned fuel flowing from the end of the pre-combustion chamber. Secondary combustion of the over-stoichiometric fuel/air mixture formed under these conditions with $\lambda>>1$ then takes place in a second combustion chamber. The desired reduction of $NO_x$ formation by such a two-stage combustion process has been confirmed experimentally, see the article by R. E. Johns "Gas turbine Engines Emissions-Problems, Progress and Future" in the journal "Progr. Energy Combust. Sci.", Vol. IV, 1978, pp. 73–113. However, difficulties occur in the practical application of this concept in that the pre-combustion generates extremely high temperatures with a correspondingly high degree of heating of the walls of the pre-combustion chamber. The usual cooling methods in normal combustion chambers, such as film cooling and convective cooling, are unsuitable for such pre-combustion chambers because under these conditions the cooling air passing into the combustion mixture brings the air ratio close to the stoichiometric region which in turn leads to heavier formation of $NO_x$ which should in fact be reduced by the incomplete pre-combustion.

OBJECTS AND SUMMARY

This invention is intended to avoid this disadvantage by means of a special conformation of the pre-combustion chamber for shielding its walls from the ignited combustion mixture by a layer of air and fuel, thereby reducing the temperature close to the walls to values which are acceptable for the material of the combustion chamber walls.

In the pre-combustion chamber, according to the invention, for sub-stoichiometric combustion, the casing of the pre-combustion chamber is essentially a rotational body which is formed by rotating a heart-shaped generatrix with a truncated tip about its axis of symmetry or about an axis of rotation lying parallel to this axis of symmetry and outside the generatrix. A circular-cylindrical or annular-cylindrical outlet duct is generated during the rotation of the generatrix due to the truncation of the tip of the heart. Extending over the boundary of this outlet duct, there is a combustion air duct of which duct the outlet openings are arranged along the boundary of the outlet duct so that the combustion air at the edge of the outlet duct can flow into the casing trangentially to its inner edge. There are injection nozzles for a liquid fuel, the axes of the nozzles being orientated so that the jets of fuel shield the combustion air flowing into the casing from the ignited combustion mixture, and there are means of supplying auxiliary air to the pre-combusted combustion mixture after this leaves the outlet duct.

In a preferred embodiment of such a combustion chamber arrangement the injection nozzles are positioned at the end of injection lines which branch from a fuel ring line surrounding the outlet duct and discharge into the casing directly radially inwardly from the outlet opening of the combustion air duct. In each case the axes of the injection nozzles are directed essentially at a tangent to the adjacent section of the wall of the casing, and there is an annular auxiliary air duct for supplying auxiliary air positioned at the end of the outlet duct.

In a structurally simpler embodiment, the injection nozzles are positioned at the end of a fuel line which discharges into the casing coaxially with the latter's axis of symmetry. The axes of the injection nozzles are directed so that the jets of fuel shield the combustion air injected into the casing from the ignited combustion mixture and the auxiliary air is drawn from the combustion air intended for the secondary combustion chamber.

BRIEF DESCRIPTION OF THE DRAWINGS

The invention is described in detail below with the aid of the embodiments shown in the drawings, in which.

DETAILED DESCRIPTION

Figure 1:
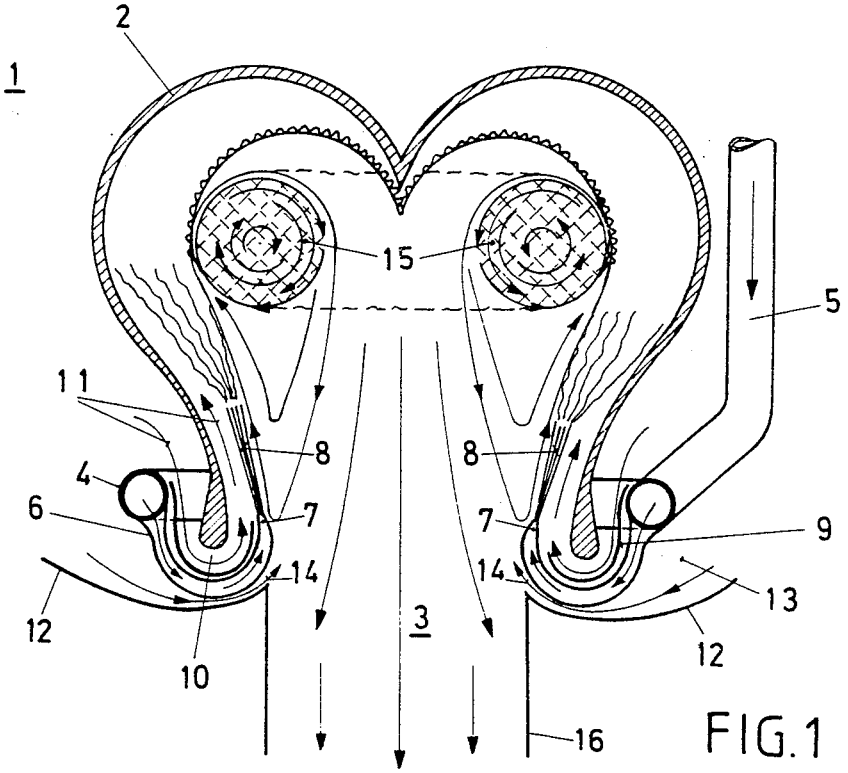
FIG. 1 is a schematic view of a pre-combustion chamber with a ring line, positioned at the outlet duct, for supplying the fuel.

In an axial section taken through the axis of rotation of the rotational body, the casing 2 of the pre-combustion chamber 1 shown diagrammatically in FIG. 1 shows the form of a heart with a truncated tip. At this point the casing terminates in an outlet duct 3 for the incompletely burned combustion mixture produced in the casing 2.

In the lower part of the casing 2 and at a distance from the same there is a fuel ring line 4 for the liquid fuel. This passes from a fuel tank which is not shown, via a feed line 5 and into the ring line 4. From this ring line there branch a number of injection lines 6, distributed equally around the circumference and curved into hook shapes, which terminate, inside the outlet duct 3, in injection nozzles 7. Jets of fuel 8 emerge from the nozzles 7, approximately parallel to the inner surface of the casing 2. Radially inwardly from the injection lines 6 there is a guide plate 9 in the shape of a rotational body which, together with the outer surface of the lower part of the casing 2, forms the boundary of an annular combustion air duct 10. The flow arrows 11 represent the combustion air, which is pre-heated in the duct 10 and, after a change in direction at the lower end of the casing 2, flows upwardly in the said casing approximately parallel to the casing wall and blends with the fuel jets 8.

A further rotationally symmetrical guide plate 12, which encloses the injection lines 6, forms, with the first-mentioned guide plate 9, the boundary of an annular auxiliary air duct 13, through which air, shown by the flow arrows 14, is added in an above-stoichiometric ratio to the pre-combusted combustion mixture in the region of the outlet duct 13. This mixture then passes into a secondary combustion chamber 16, of which part of the casing is shown, for complete combustion.

The mechanism of the shielding of the wall of the casing 2 against the high combustion temperatures which occur during the sub-stoichiometric pre-combustion is based on the tangential injection of the combustion air, which takes place over the entire inner circumference of the casing 2 and which produces a vortex ring with a toroidal vortex core 15 with a cross-section which is symbolized in FIG. 1 by the two circles of cross-hatching with broken lines. When the fuel is ignited, this vortex core contains very hot gases. The centrifugal effect causes stratification of the combustion gases of differing temperature or density which can only level out very slowly from the inside outwardly. However, in steady-state operation such a leveling out of the temperature or density from the inside outwardly is suppressed by the continuous fresh supply of fluel/air mixture. A steady-state self-shielding effect therefore occurs, which protects the casing material from unacceptable overheating. In steady-state operation the vortex core 15 also acts as a source of ignition, which ignites the sub-stoichiometric fuel/air mixture. The fuel is injected radially inwardly with respect to the combustion air layer, which is close to the wall that is insulated, and approximately as far from the core of the incompletely burned combustion mixture as the lower half of the casing 2. The result is that the combustion mixture cannot continue combustion with air from the layer close to the wall and only becomes flammable again after addition of auxiliary air from the auxiliary air duct 13, so that it can be completely burned in the secondary combustion chamber 16.

The velocity of the air injection into the pre-combustion chamber 1 should be substantially higher than the flame propagation velocity, forming a spiral flame front which ideally does not impinge on the inner surface of the casing 2. At the moment of ignition the mixing process has advanced to such an extent that there are no remaining lean mixture zones.

As already mentioned above, so much air is added from the auxiliary air duct 13 to the only partially burned combustion mixture in the region of the outlet duct 3 that complete combustion can take place under conditions which are strongly over-stoichiometric, with $\lambda >> 1$, in a secondary combustion chamber. $NO_x$ formation is therefore largely suppressed in the waste gases which have been diluted in this manner.

Figure 2:
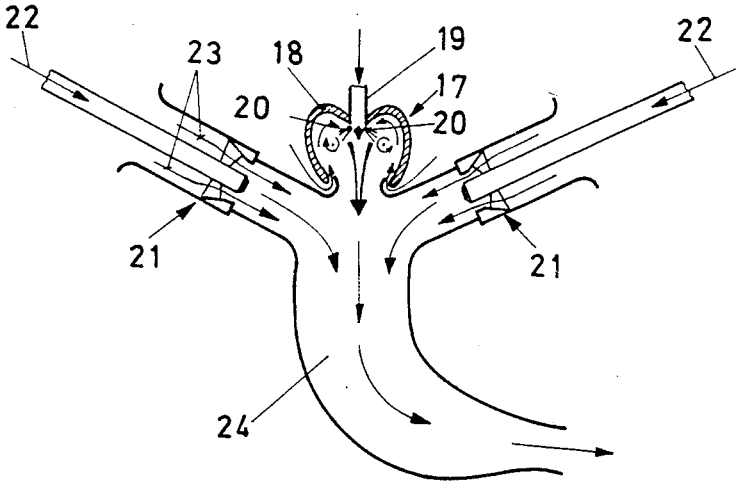
FIG. 2 is a schematic view of a combustion chamber arrangement according to the invention with a pre-combustion chamber with central fuel injection and a secondary combustion chamber designed for gas operation.

FIG. 2 shows a pre-combustion chamber 17 of simplified construction, in which the liquid fuel is supplied, via a fuel line 19 coaxial to axis of symmetry of the casing 18, to injection nozzles 20 positioned at the end of the fuel line 19. While the air for the pre-combustion, as in the design shown in FIG. 1, is injected into the casing 18 from below, close to the wall, the fuel injection takes place in the reverse direction from above at a high velocity. In this instance the axes of the nozzles are directed so that the air jets close to the wall are likewise shielded from the centrally ignited combustion mixture. Such a pre-combustion chamber 17 can with advantage be combined with gas burners distributed evenly around the circumference, of which two are shown in FIG. 2, indicated by 21. The combustion gas flowing through the gas burners is indicated by the arrows 22, and the combustion air by the arrows 23. The flow of combustion air is proportioned so that it is at least sufficient for complete combustion of the gas and for secondary combustion in the secondary combustion chamber 24 of the incompletely burned combustion mixture flowing from the pre-combustion chamber.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A combustion chamber apparatus, comprising:

a precombustion chamber for substoichiometric combustion, said precombustion chamber having a housing in which a fuel mixture is burned incomplete, said housing having a first and a second end;

said housing of the precombustion chamber including a body formed by the rotation of a symmetrical generatrix about an axis of symmetry of the generatrix, said housing including a curved interior region for guiding a flow of gases into a substantially annular vortex that is substantially concentric with said axis of symmetry;

an outlet channel formed on said housing for permitting gases to flow out of said housing along said axis of symmetry;

combustion air conduit means located about an outer periphery of said outlet channel for feeding combustion air into said housing parallel to the curved interior region of the housing such that said combustion air forms a layer adjacent the curved interior region;

liquid fuel injection nozzle means directed into the housing and located adjacent to and radially inwardly of the combustion air conduit means for directing liquid fuel into the housing with a flow that is parallel to and in the same direction as the flow of the combustion air entering through said combustion air conduit means, said flow of liquid fuel being separated from the curved interior region of the housing by said combustion air;

annular supplemental air conduit means provided at the outlet channel for blowing supplemental air into the gases exiting from the housing through the outlet channel; and a postcombustion chamber located at the outlet channel thereby communicating with the interior of the housing, gases from the housing being completely burned with the supplemental air in the post combustion chamber.

2. The apparatus of claim 1, wherein the housing includes an inwardly directed apex located at the first end of the housing coaxial to the axis of symmetry of the housing.

3. The apparatus of claim 2, wherein the wall of said housing tapers inwardly towards the second end of the housing.

4. The apparatus of claim 1, wherein the outlet channel and the combustion air conduit means are located at the second end of the housing.

5. The combustion chamber of claim 1, further comprising:

an annular fuel line surrounding the outlet channel; and injection lines branching off from said annular fuel line;

said liquid fuel injection nozzles being located at the ends of said injection lines.

6. The combustion chamber of claim 5, wherein said outlet channel is cylindrical.

7. The combustion chamber of claim 5, wherein said outlet channel is annular.

8. The combustion chamber of claim 1, wherein said outlet channel is cylindrical.

9. The combustion chamber of claim 1, wherein said outlet channel is annular.

10. A combustion chamber apparatus, comprising:

a precombustion chamber for substoichiometric combustion, said precombustion chamber having a housing in which a fuel mixture is burned incompletely, said housing having a first end and a second end;

said housing of the precombustion chamber including a body formed by the rotation of a symmetrical generatrix around an axis of rotation located parallel to an axis of symmetry and outside the generatrix, said housing including a curved interior region for guiding a flow of gases into a substantially annular vortex that is substantially concentric with said axis of symmetry;

an outlet channel formed on said housing for permitting gases to flow out of said housing along said axis of symmetry;

combustion air conduit means located about an outer periphery of said outlet channel for feeding combustion air into said housing parallel to the curved interior region of the housing such that said combustion air forms a layer adjacent the curved interior region;

liquid fuel injection nozzle means directed into the housing and located adjacent to and radially inwardly of the combustion air conduit means for directing liquid fuel into the housing with a flow that is parallel to and in the same direction as the flow of the combustion air entering through said combustion air conduit means, said flow of liquid fuel being separated from the curved interior region of the housing by said combustion air;

annular supplemental air conduit means provided at the outlet channel for blowing supplemental air into the gases exiting from the housing through the outlet channel; and a postcombustion chamber located at the outlet channel thereby communicating with the interior of the housing, gases from the housing being completely burned with the supplemental air in the postcombustion chamber.

11. The apparatus of claim 10, wherein the housing includes an inwardly directed apex located at the first end of the housing coaxial to the axis of symmetry of the housing.

12. The apparatus of claim 11, wherein the wall of said housing tapers inwardly towards the second end of the housing.

13. The apparatus of claim 10, wherein the outlet channel and the combustion air conduit means are located at the second end of the housing.

* * * * *